US006929202B2

(12) United States Patent
Haikkala et al.

(10) Patent No.: US 6,929,202 B2
(45) Date of Patent: Aug. 16, 2005

(54) METHOD AND ARRANGEMENT FOR FEEDING WOOD BATCHES INTO A PRESSURE GRINDER

(75) Inventors: Pekka Haikkala, Siivikkala (FI); Kari Harakkamäki, Ruutana (FI); Simo Setälä , Pirkkala (FI)

(73) Assignee: Metso Paper Inc., Helsinki (FI)

( * ) Notice: Subject to any disclaimer, the term of this patent is extended or adjusted under 35 U.S.C. 154(b) by 89 days.

(21) Appl. No.: 10/427,664

(22) Filed: May 1, 2003

(65) Prior Publication Data

US 2004/0026545 A1 Feb. 12, 2004

(30) Foreign Application Priority Data

May 3, 2002 (FI) ..... 20020844

(51) Int. Cl.[7] ..... B02C 1/08; B02C 13/28; B02C 17/20; B02C 23/02; B02C 7/00

(52) U.S. Cl. ..... 241/282; 241/18; 241/28; 241/281; 241/DIG. 14

(58) Field of Search ..... 241/18, 28, 281, 241/282, DIG. 14

(56) References Cited

U.S. PATENT DOCUMENTS 2,410,628 A * 11/1946 Brunette ..... 187/255
4,274,600 A * 6/1981 Haikkala ..... 241/18
4,664,323 A * 5/1987 Ahonen et al. ..... 241/282

FOREIGN PATENT DOCUMENTS

FI 57979 8/1979
FI 69653 7/1985

* cited by examiner

*Primary Examiner*—Derris H. Banks
*Assistant Examiner*—Jason Y Pahng
(74) *Attorney, Agent, or Firm*—Alston & Bird LLP

(57) ABSTRACT

A method of feeding a wood batch into a pressure grinder, the method comprising first collecting the wood batch to be fed into the grinder into a separate batch chamber above a side feeding chamber, from which the wood batch is lowered vertically by means of a separate supporting plate to the side feeding chamber. Thereafter, the wood batch is transferred from the side feeding chamber into the feeding chamber. An arrangement for feeding a wood batch into a pressure grinder comprises a batch chamber above a side feeding chamber and in which the wood batch to be fed into the pressure grinder is formed before it is lowered into the side feeding chamber.

12 Claims, 6 Drawing Sheets

METHOD AND ARRANGEMENT FOR FEEDING WOOD BATCHES INTO A PRESSURE GRINDER

BACKGROUND OF THE INVENTION

1. Field of the Invention

The invention relates to a method for feeding a wood batch into a pressure grinder, according to which method the wood batch is transferred first into a side feeding chamber, which is pressurizable to the same pressure as a continuously pressurized grinding chamber, and thereafter from the side feeding chamber into a feeding chamber where the wood batch is during grinding pushed into contact with a grinding element, such as a pulp stone, rotating in the grinding chamber, whereby the wood batch is transferred substantially horizontally from the side feeding chamber into the feeding chamber in the direction of the rotation axis of the grinding element.

The invention also relates to an arrangement for feeding wood batches into a pressure grinder, the arrangement comprising a frame forming a pressurizable grinding chamber, a rotating grinding element in the grinding chamber, a feeding chamber opening to the grinding chamber, feeding equipment for pushing a wood batch against the grinding element in the grinding chamber, a side feeding chamber on the side of the feeding chamber, a transfer apparatus for feeding the wood batch from the side feeding chamber into the feeding chamber in the direction of the shaft of the grinding element, and a feeding sluice for pressure-tight closing of a feed opening between the feeding chamber and the side feeding chamber.

2. Description of Related Art

CA Patent 1 255 530 discloses a method and equipment, wherein a wood batch is fed into a pressure grinder from the side substantially horizontally and in the direction of the rotation axis of the grinding element. This solution provides the advantage that feeding problems caused by a conventional way of dropping wood batches from above can be avoided. However, as to transferring and feeding the wood batches in particular, this solution has certain limitations, since wood must be transported and fed into the feeding chamber from the side to avoid the problems caused by the dropping. In case of grinder replacements, in particular, this means that the entire wood transportation mechanism has to be replaced, which, on one hand, increases costs and, on the other hand, causes problems in groundwood mill traffic and other functions.

BRIEF SUMMARY OF THE INVENTION

It is an object of the present invention to provide a method and an arrangement for feeding wood batches from a wood feeding conveyor moving above a grinder from the side of the grinder into a feeding chamber simply and easily and without problems.

The method of the invention is characterized by collecting the wood batch to be fed first into a separate batch chamber above the side feeding chamber, by lowering said wood batch vertically by means of a separate supporting plate from the batch chamber to the side feeding chamber and only thereafter transferring it from the side feeding chamber into the feeding chamber.

The arrangement of the invention is characterized in that the arrangement comprises a batch chamber which is above the side feeding chamber and in which the wood batch is formed before it is fed into the side feeding chamber, that between the batch chamber and the side feeding chamber there is an inlet opening provided with a closing sluice which can be closed pressure-tightly, through which opening the formed wood batch can be transferred into the side feeding chamber, and a supporting plate which can be lifted and lowered by using transfer means and by which the wood batch formed in the batch chamber can be lowered as one whole to the side feeding chamber to transfer it from there into the feeding chamber.

The essential idea of the invention is that wood is dropped from a conveyor first to a separate batch chamber above a side feeding chamber, wherefrom the wood batch is lowered by means of a separate supporting element moving inside the side feeding chamber down to the side feeding chamber, from which the wood is then transferred in a known manner to a feeding chamber of a grinder to be ground.

The invention provides the advantage that a wood batch can be collected into a separate batching chamber, after which the wood batch, supported on the side walls of the batching chamber, can be transferred with a separate supporting element in a controlled manner from the batching chamber via an opening, which is located between the batching chamber and a side feeding chamber and can be opened and closed by means of a separate sluice, down to the side feeding chamber, and, after the sluice is closed, the wood batch can be transferred to the feeding chamber of the grinder without falling freely at any stage of the transfer. In this way, feeding problems due to free falling of a wood batch can be avoided easily and simply.

BRIEF DESCRIPTION OF THE SEVERAL VIEWS OF THE DRAWINGS

The invention will be described in greater detail in the attached drawings, in which FIGS. 1*a* and 1*b* schematically show a partial section of a prior art grinder from the side and from above respectively, FIGS. 2*a* and 2*b* schematically show a partial section of an arrangement of the invention from the side and from an end respectively, FIGS. 3*a* to 3*c* schematically illustrate operation of a method and arrangement of the invention by using the section of FIG. 2*b*, FIGS. 4*a* to 4*c*, in turn, show a second embodiment of the method and arrangement of the invention by using the section of FIG. 2*b*, and FIG. 5 schematically shows a third embodiment of the invention by using the section of FIG. 2*b*, and FIGS. 6*a* to 6*c* schematically show a fourth embodiment of the invention by using the section of FIG. 2*b*.

DETAILED DESCRIPTION OF THE INVENTION

Figure 1A:
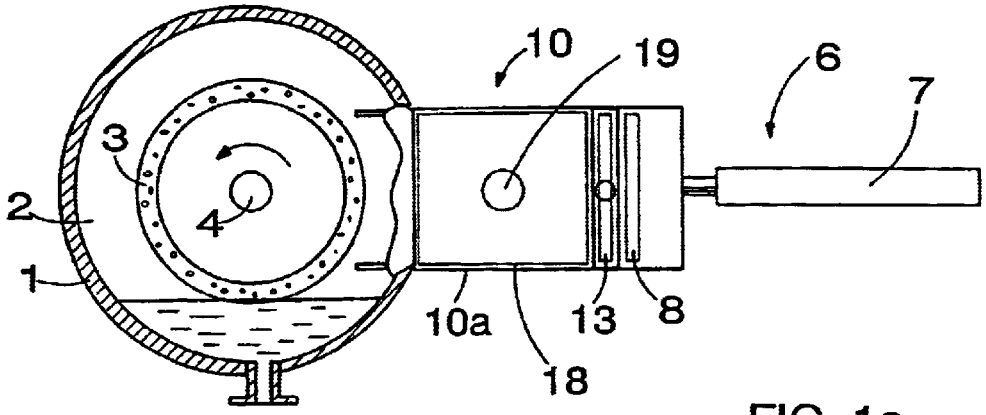
FIG. 1a PRIOR ART
Figure 1B:
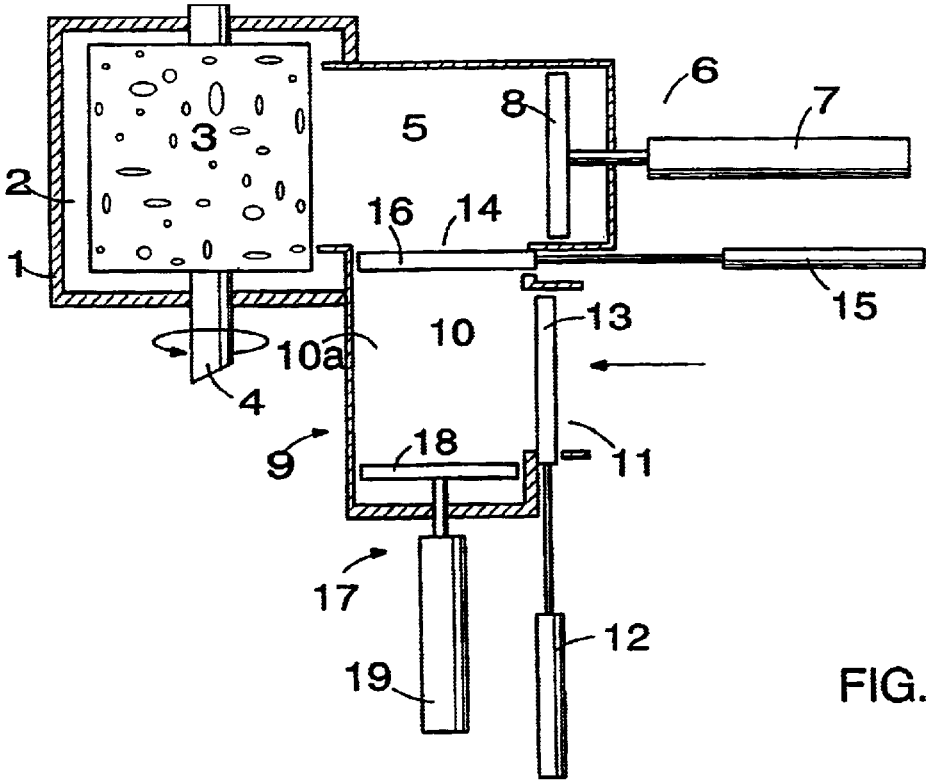
FIG. 1b PRIOR ART

FIGS. 1*a* and 1*b* show a partial section of a prior art grinder from the side and from above, respectively. The grinder typically comprises a pressure-tight frame 1, inside of which there is a grinding space 2. A pulp stone 3 is rotatably mounted in the grinding space 2 to rotate around a shaft 4. The shaft 4, for its part, is connected to a non-shown rotation motor known per se, which is used for rotating the pulp stone 3. The frame 1 is further connected with a feeding chamber 5 which is open towards the pulp stone 3 and has a rectangular cross-section and at the other end of which there is a feeding shoe 8 operated by a hydraulic cylinder 7 of feeding equipment 6.

On the other side of the feeding chamber 5 there is a side feeding apparatus 9, which is provided with a side feeding chamber 10 having preferably a rectangular cross-section. Bottoms 10*a* and 5*a* of the side feeding chamber 10 and of the feeding chamber 5 are in the same level, or the bottom 10*a* of the side feeding chamber can be located a bit higher than the bottom of the feeding chamber 5.

In the prior art, a side of the side feeding chamber 10 comprises an inlet opening 11, in connection of which there is a closing sluice 13 operated by a separate pressure-medium cylinder 12. The closing sluice 13 provides the inlet opening 11 with pressure-tight closure. The end of the side feeding chamber 10 facing the feeding chamber 5 comprises a transfer opening 14, which leads to the feeding chamber 5 and can, correspondingly, be closed pressure-tightly by means of a feeding sluice 16 operated by a pressure-medium cylinder 15. The end of the side feeding chamber 10 opposite to the feeding chamber 5 is provided with a transfer apparatus 17, which comprises a transfer piston 18 inside the side feeding chamber 10 and a pressure-medium cylinder 19 connected thereto, which can be used for pushing a wood batch from inside of the side feeding chamber 10 to the feeding chamber 5 one batch at a time.

Figure 2A:
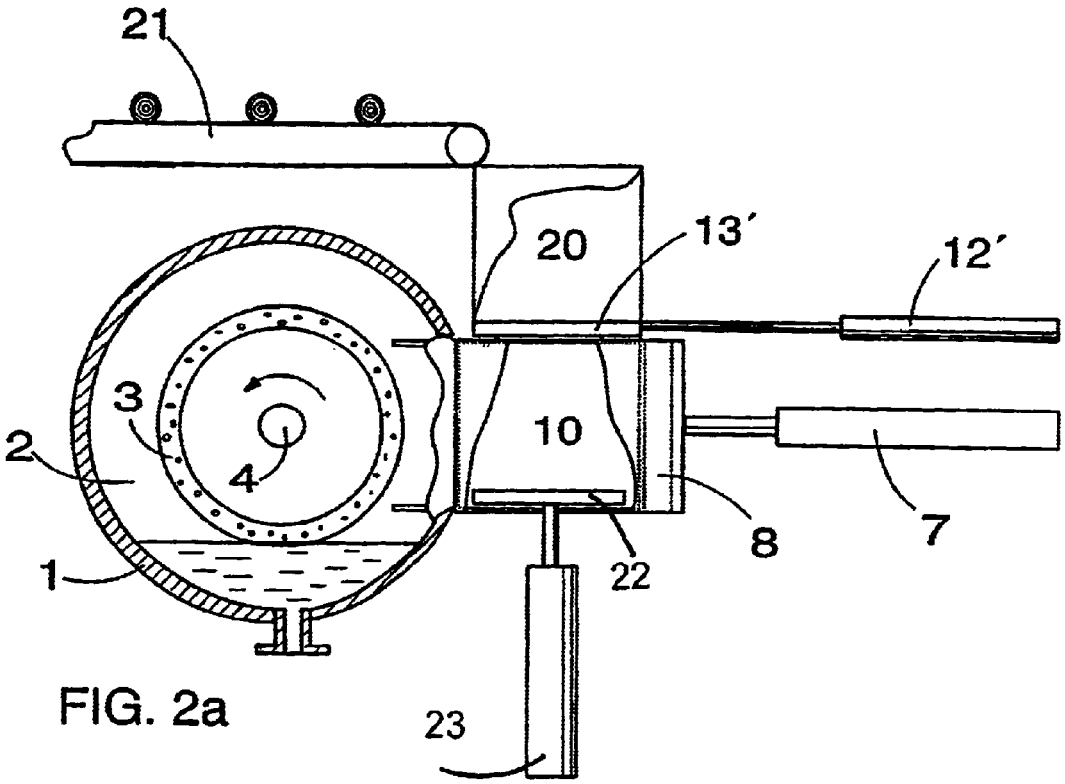
Figure 2B:
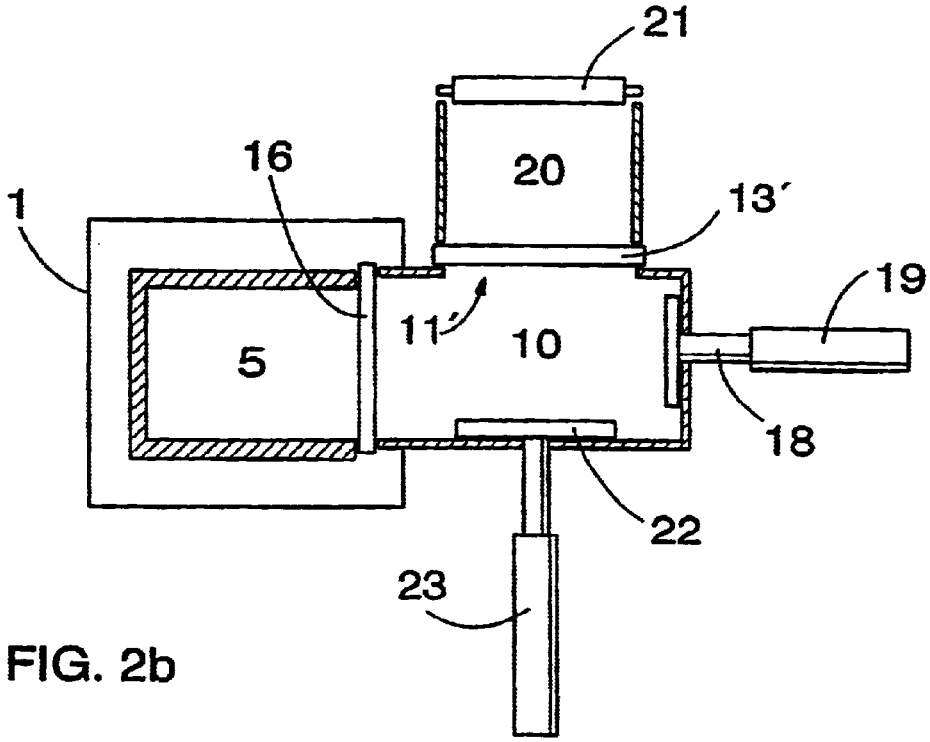

FIGS. 2*a* and 2*b* schematically show a partial section of an arrangement of the invention from the side and from an end, respectively. As appears from the figures, in the arrangement of the invention the sides of the side feeding chamber 10 are uniform, and an inlet opening 11' for feeding a wood batch into the side feeding chamber 10 is formed in the upper part of the side feeding chamber. Above the side feeding chamber there is, respectively, a closing sluice 13', by which the inlet opening 11' above the side feeding chamber 10 can be closed pressure-tightly. Above the side feeding chamber 10 there is a batch chamber 20, to which a wood batch to be fed into the grinder at one time can be fed by using a separate wood conveyor 21. The upper side of the batch chamber 20 is open so that cut-to-size logs of wood supplied from the conveyor 21 can, one at a time, fall freely thereto. The figure also shows a supporting plate 22, which is located on the bottom of the side feeding chamber and arranged to be lifted and lowered by means of a suitable power unit. The supporting plate 22 is located on the bottom of the side feeding chamber 10, thus forming a basal surface, along which the wood batch in the side feeding chamber 10 is pushed into the feeding chamber 5. The lifting and lowering mechanism of the supporting plate 22 can be, for instance, a pressure-medium cylinder 23 or another lifting and lowering mechanism functioning in a manner known per se and forming the transfer means for the supporting plate 22.

Figure 3A:
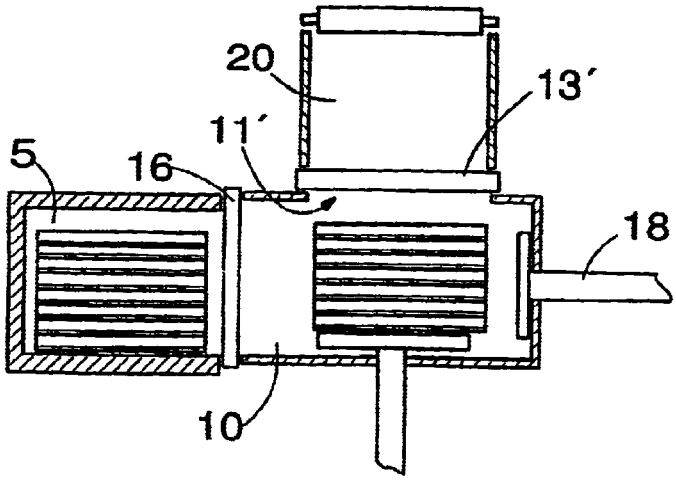
Figure 3B:
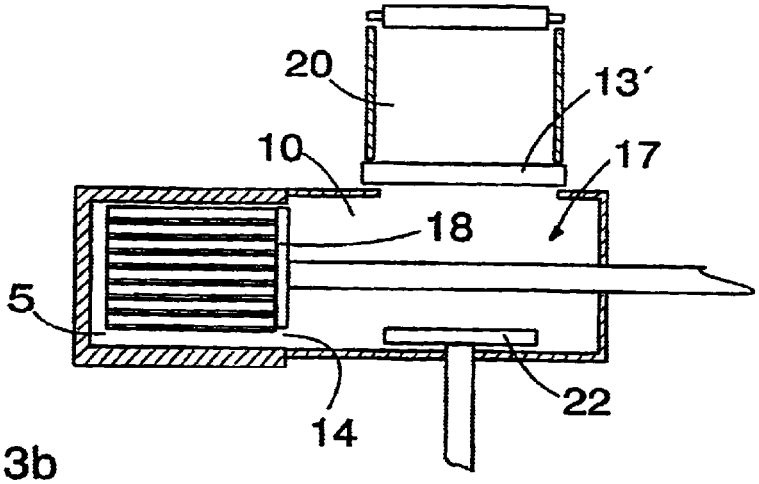
Figure 3C:
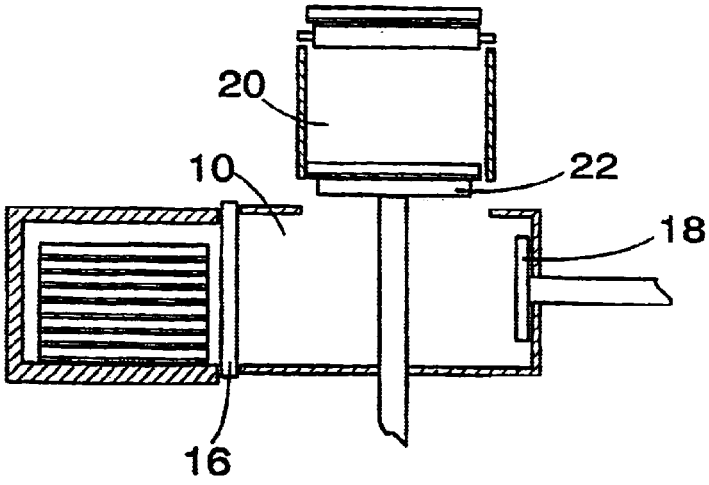

FIGS. 3*a* to 3*c* schematically illustrate operation of a method and arrangement of the invention from the direction of FIG. 2*b*. FIG. 3*a* illustrates a situation where the feeding chamber 5 of the grinder contains a wood batch, which is pushed against the pulp stone 3 in a manner known per se during the grinding while the pulp stone is rotating. Simultaneously, water is fed to the grinder in a conventional way to form a fiber pulp mixture and to cool the pulp stone. Correspondingly, the side feeding chamber 10 contains a new wood batch waiting to be transferred into the feeding chamber 5. The sluice 13' of the inlet opening 11' above the side feeding chamber is pushed into its place so that the inlet opening 11' is closed. The batch chamber 20 is empty, since the wood batch it contained has been transferred to the side feeding chamber 10.

FIG. 3*b* illustrates a situation where the grinding of the wood batch which was in the feeding chamber 5 is now completed and a new wood batch is transferred from the side feeding chamber 10 to the feeding chamber 5. In this case, the feeding sluice 16 closing the transfer opening 14 between the side feeding chamber 10 and the feeding chamber 5 is moved to the side so that the transfer opening 14 is open and the wood batch is pushed by means of the transfer piston 18 of a pushing device 17 so that the wood batch is transferred to the feeding chamber 5. In this case, the feeding shoe 8, which can be seen in FIGS. 1*a* and 1*b*, is pulled accordingly to its rearmost position to transfer the wood batch to the feeding chamber 5. When the wood batch is pushed to the feeding chamber 5, the transfer piston 18 is pulled back and the feeding sluice 16 is pushed into its place so that the feeding chamber 5 and the side feeding chamber 10 are separated from each other pressure-tightly.

FIG. 3*c*, for its part, shows how a new wood batch is fed into the side feeding chamber. The closing sluice 13' above the side feeding chamber is moved to the side so that the supporting plate 22 on the bottom of the side feeding chamber 10 is lifted as high as to the lower part of the batch chamber 20. Thereafter, cut-to-size logs are brought with the conveyor, the logs falling onto the supporting plate 22, until the number of logs in the batch chamber 20 corresponds to that of one wood batch. Supported by the supporting plate 22, this wood batch is lowered down to the side feeding chamber 10, after which the closing sluice 13' is closed pressure-tightly so that when a new wood batch is fed, the side feeding chamber can be pressurized to the same pressure as the feeding chamber 5 and the grinding chamber 2 before the transferring of the wood batch into the feeding chamber is started.

Figure 4A:
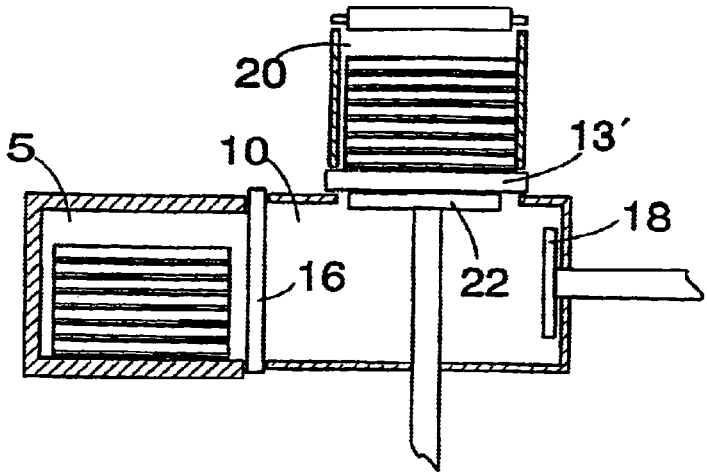
Figure 4B:
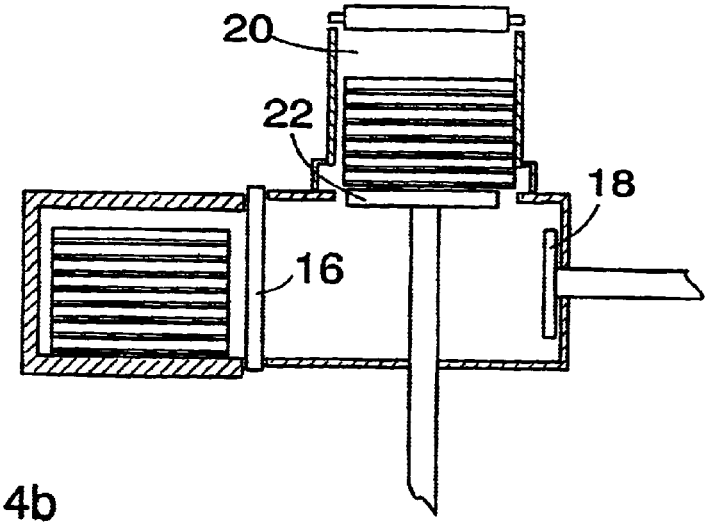
Figure 4C:
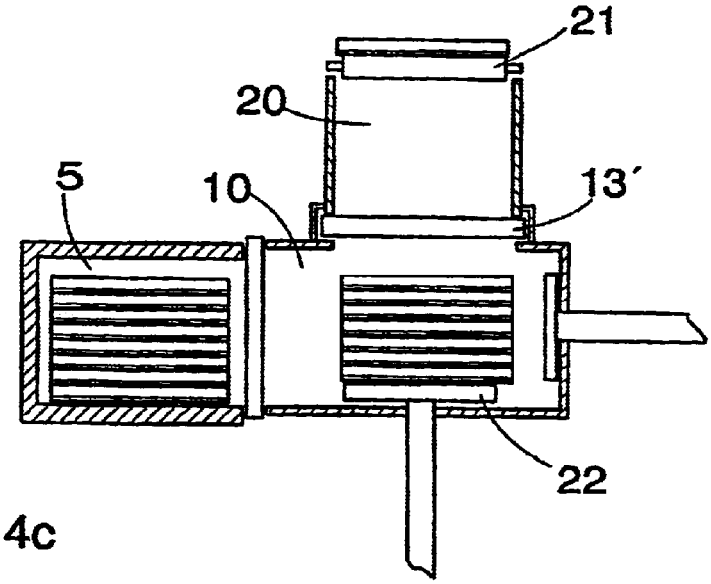

FIGS. 4*a* to 4*c*, in turn, show a second embodiment of the method and arrangement of the invention. In this embodiment, as FIG. 4*a* shows, a wood batch is dropped onto the closing sluice 13' of the batch chamber 20 to wait until it is possible to lower the batch to the side feeding chamber 10. The wood in the side feeding chamber 10 was already transferred into the feeding chamber 5 earlier in a manner shown in FIGS. 3*a* to 3*c* and the transfer piston 18 is brought back to the end of the side feeding chamber 10. The supporting plate 22, for its part, is lifted up in a manner shown in the figure so that it is immediately under the closing sluice 13' ready to receive a wood batch from the batch chamber 20.

FIG. 4*b* shows a situation where the closing sluice 13' is pulled to the side from under the wood batch and the wood batch is lowered onto the supporting plate 22 so that the walls of the batch chamber 20 keep it in good order.

FIG. 4*c*, in turn, shows a situation where a wood batch is lowered with the supporting plate 22 down to the side feeding chamber 10, after which the closing sluice 13' can be closed so that the side feeding chamber 10 is closed pressure-tightly in respect of the outside air and, to feed the wood batch into the feeding chamber 5, can be pressurized in a known manner to the same pressure as the feeding chamber and the grinding chamber 2. At the same time, the batch chamber 20 can be filled again by feeding logs of wood from the conveyor 21 to the batch chamber.

Figure 5:
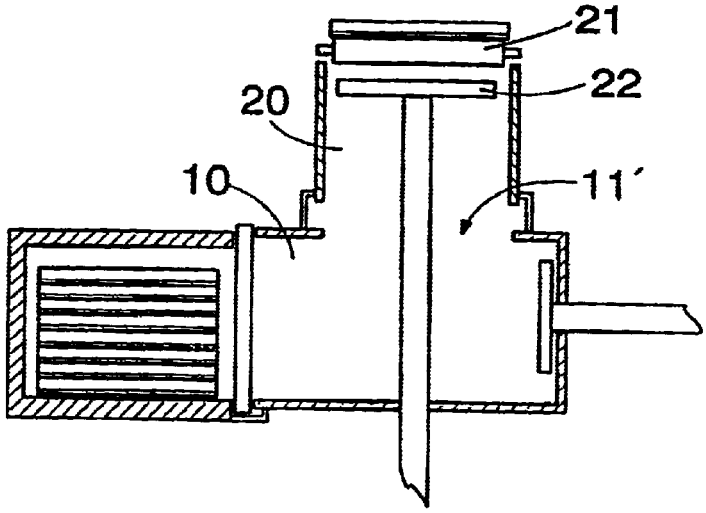

FIG. 5 schematically shows a third embodiment of the method and arrangement of invention, which otherwise corresponds to the embodiment of FIGS. 3*a* to 3*c*, but the operational distance of the supporting plate 22 is longer than in the other embodiments. In this embodiment, the supporting plate 22 can be lifted nearly as high as to the level of the conveyor 21. In this case, logs of wood supplied from the conveyor 21 to the supporting plate 22 fall only a short distance, and therefore they do not move restlessly nor are they set obliquely onto the supporting plate 22. When new logs are fed onto the supporting plate 22 in the batch chamber 20, the supporting plate 22 is simultaneously lowered so that the falling distance of new logs remains quite short, until a suitable batch of wood is formed on top of the supporting plate 22 and it can be lowered through the opening 11' to the side feeding chamber 10.

Figure 6A:
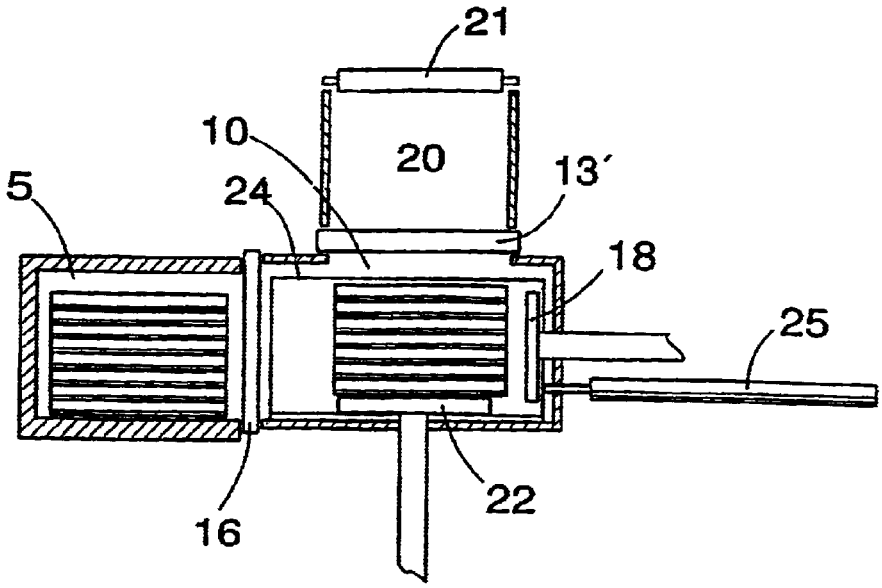
Figure 6B:
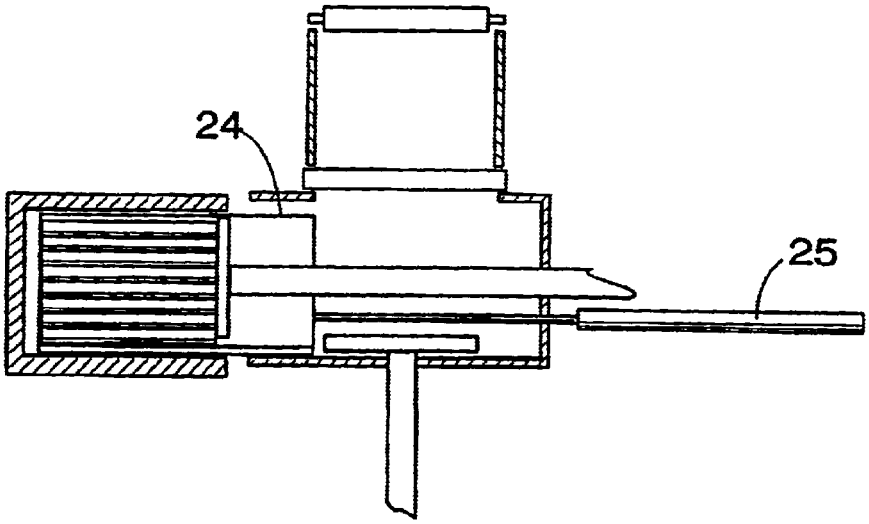
Figure 6C:
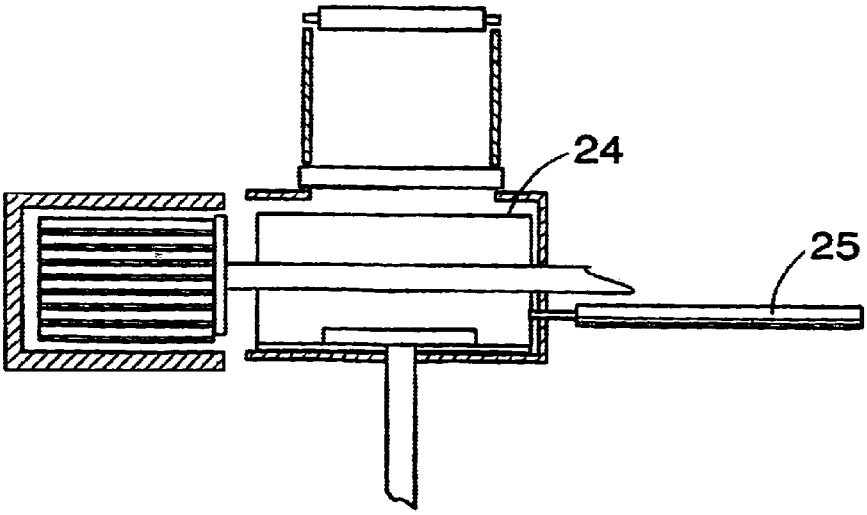

FIGS. 6*a* to 6*c* show a fourth embodiment of the method and arrangement of the invention, which may be a solution based on one of the embodiments of the invention shown above, whereby the numbering of the parts corresponds to the numbering previously used for identical parts. This embodiment of the invention differs from the previous embodiments in that it comprises a separate transfer support 24, which is used for maintaining a wood batch in a suitable shape during the transfer. The transfer support 24 is a trough provided with an opening on its upper side or a supporting frame formed by sides connected to each other in the transverse direction, into which transfer support a wood batch is lowered by means of the supporting plate 22 so that it is supported by the side walls 24*a* of the transfer support 24. When the wood batch is transferred from the side feeding chamber 10 into the feeding chamber 5, the transfer support 24, along with the wood batch, is simultaneously transferred by using the transfer means, such as a transfer cylinder 25 until the entire wood batch is in the feeding chamber 5. After this, most preferably the transfer support 24 is first pulled out of the feeding chamber back to the side feeding chamber 10, while the transfer piston 18 supports the wood batch at its end and thus hinders it from moving back along with the transfer support 24. FIG. 6*b* illustrates this. When the transfer support 24 is pulled back to the side feeding chamber 10 and the transfer piston 18 is pulled out of the feeding chamber 5, the sluice 16 can be closed and the grinding of the wood batch in the feeding chamber 5 can be started.

In the above description and drawings, the invention is described only by way of example and it is not restricted thereto in any way. It is essential that a wood batch is collected from a conveyor above a grinder, specifically to a batch chamber above a side feeding chamber, and then transferred from the batch chamber in a controlled manner, supported by a supporting plate or a similar supporter, to the side feeding chamber so that the shape of the wood batch is maintained, after which the side feeding chamber is closed pressure-tightly in respect of the outside air and, when the wood batch is transferred into the feeding chamber, the side feeding chamber is pressurized to the same pressure as the feeding chamber and the grinding chamber to transfer the wood batch in a controlled manner in the direction of the grinder shaft from the side feeding chamber to the feeding chamber to be fed against the pulp stone.

That which is claimed:

1. A method for feeding a wood batch into a pressure grinder having a grinding element rotating in a continuously pressurized grinding chamber for grinding the wood, comprising the steps of:

collecting the wood batch in a batch chamber;

transferring the wood batch from the batch chamber into a side feeding chamber, which is pressurizable to the same pressure as the grinding chamber;

moving the wood batch from the side feeding chamber into a feeding chamber where the wood batch during grinding is pushed into contact with the grinding element, wherein the wood batch is transferred substantially horizontally from the side feeding chamber into the feeding chamber in the direction of the rotation axis of the grinding element;

wherein the batch chamber is arranged above the side feeding chamber, and the step of transferring the wood batch into the side feeding chamber comprises lowering said wood batch vertically by means of a separate supporting plate from the batch chamber to the side feeding chamber and only thereafter transferring it from the side feeding chamber into the feeding chamber.

2. A method as claimed in claim 1, wherein a wood batch is formed by feeding wood logs with a conveyor to the batch chamber, until a desired wood batch is formed.

3. A method as claimed in claim 2, wherein a wood batch is formed by collecting wood logs onto a closing sluice between the batch chamber and the side feeding chamber.

4. A method as claimed in claim 2, wherein a wood batch is formed by collecting wood logs on the supporting plate lifted through the side feeding chamber.

5. A method as claimed in claim 4, wherein, to collect a wood batch, the supporting plate is lifted close to the conveyor and, as the number of wood logs on the supporting plate increases, the supporting plate is lowered.

6. A method as claimed in claim 1, wherein the wood batch to be transferred from the side feeding chamber to the feeding chamber is supported on its sides by means of a transfer support so that the wood batch to be transferred substantially maintains its shape until it has been completely transferred into the feeding chamber.

7. A method as claimed in claim 6, wherein said transfer support is transferred out of the feeding chamber so that the wood batch pushed into the feeding chamber is simultaneously supported at its end facing the side feeding chamber so that the wood batch remains in the feeding chamber.

8. An arrangement for feeding wood batches into a pressure grinder having a pressurizable grinding chamber and a rotating grinding element in the grinding chamber, the arrangement comprising:

a feeding chamber for containing a wood batch, the feeding chamber opening into the grinding chamber;

feeding equipment for pushing a wood batch in the feeding chamber against the grinding element in the grinding chamber;

a side feeding chamber on one side of the feeding chamber for receiving a wood batch to be transferred into the feeding chamber, a transfer apparatus for transferring the wood batch from the side feeding chamber into the feeding chamber in the direction of a rotation axis of the grinding element, and a feeding sluice for pressure-tight closing of a feed opening between the feeding chamber and the side feeding chamber; and a batch chamber disposed above the side feeding chamber and in which a wood batch is formed before the wood batch is transferred into the side feeding chamber, an opening provided between the batch chamber and the side feeding chamber through which opening the formed wood batch is transferred into the side feeding chamber, and a supporting plate vertically movable between the batch chamber and the side feeding chamber for lowering the formed wood batch from the batch chamber into the side feeding chamber.

9. An arrangement as claimed in claim 8, wherein the supporting plate is movable through the side feeding chamber at least substantially to the level of the opening between the batch chamber and the side feeding chamber.

10. An arrangement as claimed in claim 9, wherein the supporting plate is movable substantially as high as the upper part of the batch chamber.

11. An arrangement as claimed in claim 8, further comprising a pressure-medium cylinder for lifting and lowering the supporting plate.

12. An arrangement as claimed in claim 8, further comprising a separate transfer support with support walls in the direction of vertical sides of the side feeding chamber, the walls supporting the wood batch in its cross direction, and transfer means for transferring the transfer support simultaneously with the wood batch into the feeding chamber in such a manner that the wood batch substantially maintains its shape during the transfer.

* * * * *